United States Patent [19]

Weber

[11] Patent Number: 4,566,206

[45] Date of Patent: Jan. 28, 1986

[54] SHOE HEEL SPRING SUPPORT

[76] Inventor: Milton N. Weber, 20655 Audette, Dearborn, Mich. 48124

[21] Appl. No.: 600,886

[22] Filed: Apr. 16, 1984

[51] Int. Cl.[4] ..... A43B 3/10

[52] U.S. Cl. ..... 36/7.8; 36/27; 36/38

[58] Field of Search ..... 36/102, 103, 105, 38, 36/27, 7.8, 83, 28, 35 R

[56] References Cited

U.S. PATENT DOCUMENTS

| | | | |
|---|---|---|---|
| 324,065 | 8/1885 | Andrews | 36/37 |
| 699,297 | 5/1902 | Eick | 36/37 |
| 857,816 | 6/1907 | Luzzi | 36/37 |
| 1,098,804 | 6/1914 | Pastor et al. | 36/38 |
| 1,218,392 | 3/1917 | Gay | 36/38 |
| 1,625,048 | 4/1927 | Nock | 36/38 |
| 3,822,490 | 7/1974 | Murawski | 36/105 |
| 4,360,978 | 11/1982 | Simpkins | 36/7.8 X |

FOREIGN PATENT DOCUMENTS

| | | | |
|---|---|---|---|
| 414031 | 6/1910 | France | 36/38 |
| 1014999 | 6/1952 | France | 36/38 |
| 633409 | 2/1962 | Italy | 36/38 |

*Primary Examiner*—Henry S. Jaudon
*Assistant Examiner*—T. Graveline
*Attorney, Agent, or Firm*—Cullen, Sloman, Cantor, Grauer, Scott & Rutherford

[57] ABSTRACT

An undamped spring having multi-spring rates is provided in the heel support portion of a shoe for resiliently compressing under heel pressure against the ground and returning a substantial portion of the energy of the pressure to the wearer's foot. The spring is formed of upper and lower leaf-like legs which are integrally joined together at an acute angle whose apex is directed forwardly relative to the shoe. An intermediate leaf-like leg is located between and integrally joined with one and extended towards the other of the upper and lower legs. Thus, heel pressure compresses the upper leg towards the lower leg until the intermediate leg is engaged and, thereafter, spring compression continues at an increased spring rate.

8 Claims, 8 Drawing Figures

SHOE HEEL SPRING SUPPORT

BACKGROUND OF INVENTION

The bottoms of conventional shoes, regardless of the design or the purpose of the shoes, have a forward sole supporting portion and a rearward heel supporting portion. As the wearer walks or runs, the heel typically strikes the ground first and the force or pressure of the contact is transmitted initially through the heel to the ground.

In those types of shoes which have heel portions formed of a resilient or rubber-like material, the heel contacting force against the ground is absorbed, to some extent by the heel portion. The resiliency of the heel portion makes the step somewhat more comfortable for the wearer as compared with a hard, for example, leather type, heel. However, even with relatively soft, resilient heel portions, after a considerable period of walking or running, the initial impacts between the heel and the ground adversely affect the wearer's foot heel portion. Thus, it would be desirable to provide a shoe heel portion which more readily spreads out the initial contacting impact against the ground so as to reduce the reaction forces to the wearer's foot and, thereby, make the shoe more comfortable for a long period of time. In addition, it would be desirable, if feasible at low cost, to return a portion of the normal energy expended during walking or running to the wearer's foot for reutilization in the walking and running movement. Further, there is a need to reduce the fatigue in leg muscles which are caused by long periods of walking or running and which are typically experienced by most people.

Consequently, the invention herein relates to a springy support for the heel portion of a shoe which functions to make the shoe more comfortable, particularly after long periods of walking or running, as well as to return a substantial portion of the energy of ground impact to the wearer's foot in a useful form.

SUMMARY OF INVENTION

The invention herein contemplates a springy support for the heel of conventional shoes, regardless of the design of the shoes, which support provides a multi-spring rate system for compressing during walking or running and for returning the expended energy. The spring is generally formed of a pair of resilient leaf-like legs which are joined together at an acute angle apex to form a sharp V-shape, between which is a third leg integrally joined to one of the other two. The V-shape spring is secured to the heel portion of a shoe, either within the sole or heel construction or forming a separate heel construction.

When walking, the impact of each step is transmitted through the heel to the ground which causes the spring to compress at a first spring rate until the intermediate leg is actuated by contact with one of the other two legs, and thereafter, the spring rate changes with a greater resistance to deflection relative to increased impact force. Thus, the initial, sharp impact of the heel upon the ground is spread over a greater period of time and its reaction force upon the wearer's foot considerably softened.

The spring support may be used with sport or athletic types of shoes or footwear, regardless of the physical design or aesthetic appearance. Likewise, it may be used on general purpose footwear, such as shoes or boots for general walking or hiking or the like. Significantly, the spring is formed of an inexpensive material, such as undamped springy plastic. Examples are a suitable nylon or fiberglass reinforced resin or the like, which tend to return almost all of the energy received during compression.

A significant aspect of this invention is that the V-shaped spring first, tends to compress together to a point where the intermediate leg contacts one of the outer legs and, second, at that point increases the spring resistance so that the spring, in essence, has two different spring rates. This serves to receive and thereafter discharge the undamped energy put into the spring by the pressure of the wearer's heel against the ground. Further, this materially reduces the intensity of the shock forces transmitted up through the wearer's legs at each step or impact with the ground and consequently, reduces the leg muscle fatigue commonly experienced after long periods of walking or running.

These and other objects and advantages of this invention will become apparent upon reading the following description, of which the attached drawings form a part.

DETAILED DESCRIPTION

Figure 1:
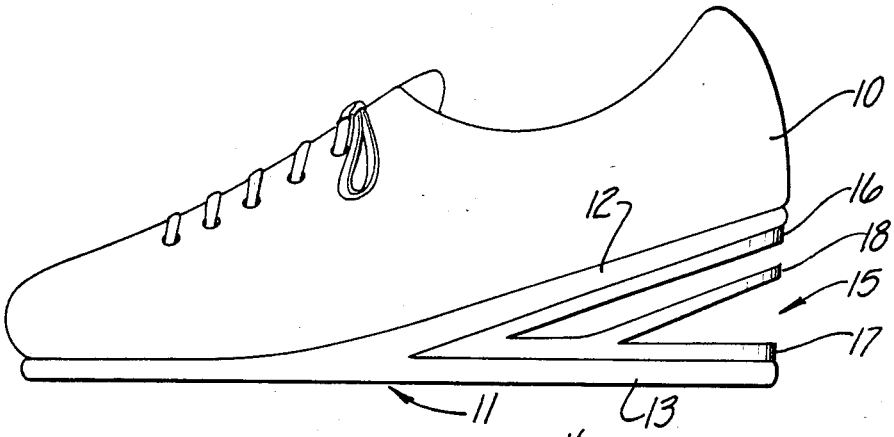
FIG. 1 is an elevational view of a typical running shoe with the heel spring support.
Figure 2:
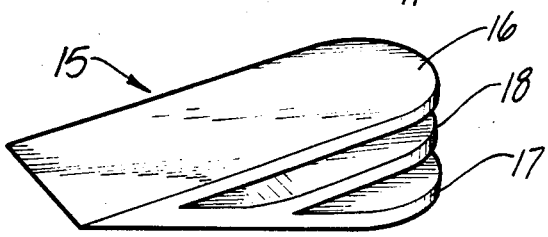
FIG. 2 is a perspective view of the spring support per se.

FIG. 1 illustrates, schematically, a conventional running shoe 10. However, the sole 11 is formed with a split rear part having an upper portion 12 and a lower portion 13. Thus, the sole forms a forward portion and a rear, split heel portion.

A spring 15 is arranged within the split heel part of the sole. This spring preferably is made of a springy plastic material which has the characteristic of an undamped spring, such as of a nylon or fibrous glass reinforced resin used to make archery bows or the like. The spring is V-shaped in configuration and has an upper leaf-like leg 16, a lower, leaf-like leg 17 and an intermediate leaf-like leg 18. The upper and lower legs are integrally joined together at a sharp, acute angle apex. Thus, the free ends of the legs are vertically spaced apart.

The intermediate leaf-like leg 18 is integral with the lower leg and extends rearwardly and roughly parallel with the upper leg. The spring may be secured within the split sole adhesively, using a conventional adhesive that is used in the manufacture of shoes. Alternatively, the spring may be molded as part of the sole. Thus, it forms part of a heel-like configuration for the shoe.

Figure 3:
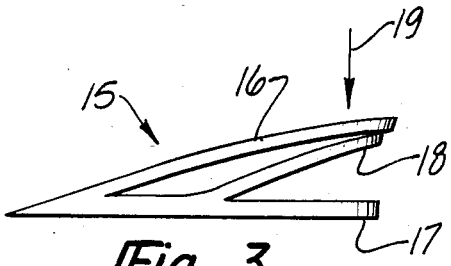
FIG. 3 is an elevational view of the spring support, showing the compression of the legs under impact or pressure.

In operation, when the wearer walks or runs, his heel strikes towards the ground first and the pressure (signified by the arrow 19 in FIG. 3) first causes the upper leaf to compress or move downwardly towards the lower leaf in a compression action somewhat similar to a conventional "wishbone". The compression occurs at an approximately uniform spring rate. However, when the upper leaf engages against the free end of the intermediate leaf, the spring resistance of the intermediate leaf is actuated and a second spring rate occurs. This latter spring rate is much stiffer than the former, that is, it takes a considerably greater load per unit deflection.

Figure 4:
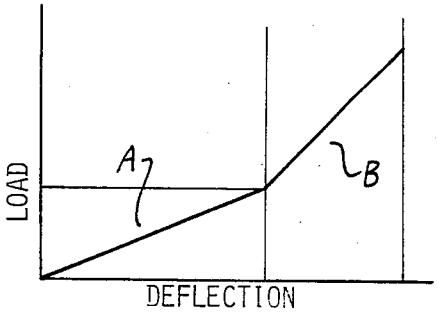
FIG. 4 diagrammatically shows the spring rates, that is, the load versus deflection curves, during compression of the upper and lower legs and then after the intermediate leg becomes actuated.

FIG. 4 schematically illustrates the two spring rates, that is, the first rate "A" signifying the compression of the upper leaf spring downwardly under the pressure of the heel impact towards the ground. Thereafter, the spring rate changes as signified by the line "B" on the diagram in FIG. 4 to show the more compression resistant phase of the spring. The spring discharges its accumulated energy in the same manner, but reversely to the direction of the curve.

Depending upon the force, which will vary depending upon the speed of walking or the speed and impact of running or jumping, as the case may be, the spring will compress either one or both leafs and consequently, absorb the impact energy resiliently within the spring. Upon release of the pressure, i.e., as the foot rolls forward upon the forward sole portion, the energy stored within the spring rebounds, since the spring acts as if it were undamped, to give a physical assist to the foot in its forward, continuous movement. In addition, the resilient absorption of the energy momentarily will reduce the intensity of the reactive impact upon the foot during the heel engaging part of the step so as to reduce fatigue upon the leg muscles, leg injuries and the like.

Figure 5:
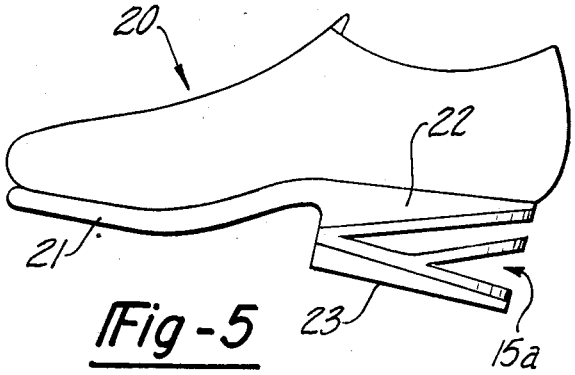
FIG. 5 is an elevational view of a modified form showing the spring support mounted within a split heel.

FIG. 5 illustrates a modification wherein a shoe or boot having either a separate or an integral conventional heel is provided with the spring of this invention. Hence, the modified shoe 20, which can be of any conventional design, is formed with a conventional sole 21 and a heel portion. The heel is cut or split with the upper part of the heel 22 being arranged at a wedge or tapered angle from front to rear. Likewise, the lower portion of the heel 23 is wedge shaped, but oppositely tapered to that of the upper portion. Consequently, the surfaces of the upper and lower heel portions generally match the angularity of the surfaces of the spring which may be adhesively secured in place. The spring 15*a* is essentially the same as spring 15 described above, except that its apex may be cut or truncated to better fit the configuration of the heel.

Figure 6:
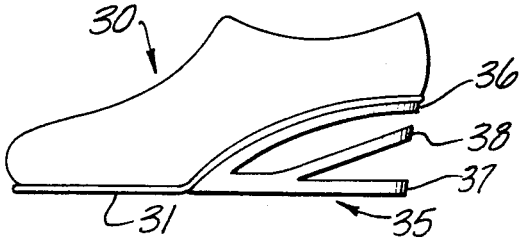
FIG. 6 is a second modification showing the spring support forming a separate heel for a shoe.

FIG. 6 illustrates a modification in which the shoe 30 is provided with a complete sole 31 and the spring forms the heel of the shoe. For that purpose, the spring 35 has its upper leaf 36 curved to fit the curvature of the particular style shoe bottom. However, the lower leaf 37 may be formed flat or contoured to engage the ground as if it were the bottom surface of a conventional heel. For example, it may be roughened or knurled or the like.

The inner or intermediate leg 38 is formed the same as that set forth above in connection with the modifications of FIGS. 1 and 5.

Figure 7:
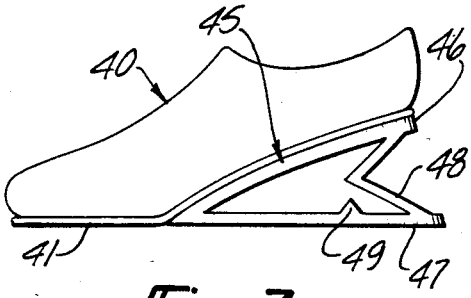
FIG. 7 is a third modification showing a spring support with a V-shaped form of intermediate leg.

FIG. 7 illustrates a third modification wherein the shoe 40 is provided with a complete sole 41 to which is connected, as by adhesive, a spring 45. This spring is formed with an upper leaf-like leg 46, a lower, leaf-like leg 47 and an intermediate leg which is V-shaped and integrally connected to both of the upper and lower legs. A stop 49 is formed on the lower leg near the apex of the intermediate leg. Hence, initial compression causes the upper leg 46 to move downwardly towards the lower leg and simultaneously compresses the intermediate V-shaped leg. After sufficient compression, the apex of the intermediate leg engages the stop 49 and, at that point, the spring rate changes due to the stiffening of the intermediate spring.

Figure 8:
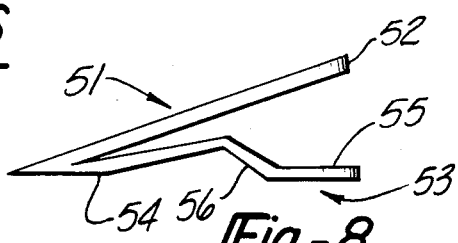
FIG. 8 is a fourth modification showing the intermediate leg formed as part of the lower leg of the V-shaped spring.

FIG. 8 illustrates a modified form of spring 51 whose upper leg 52 is similar to that illustrated previously. However, its lower leg 53 is formed with a forward part 54 and a separate rear part 55, with the forward and rear parts interconnected by a portion 56 which forms the intermediate leg part. Thus, the upper leg is fastened to the bottom of the shoe. The lower leg may be ground engaging or may be fastened within a heel or heel forming portion of a sole on a conventional shoe. Upon impact with the ground, the upper leg moves downwardly until it bottoms out against the lower leg forward portion, at which time, the intermediate part 56 changes the spring rate, that is, materially increases the spring resistance.

I claim:

1. A springy heel shoe comprising:

a shoe formed for receiving a wearer's foot and having a bottom which is generally formed as a forward sole portion and a rearward heel portion;

an undamped, compression spring means provided at the heel portion for resiliently compressing under the pressure of the rear, heel portion of the wearer's foot directed towards the ground support, and for resiliently expanding upon release of such pressure for returning a substantial portion of the energy of such pressure;

said spring means being formed of an integral V-shape, made of a stiff, springy material, providing an upper leaf-like leg and a lower, leaf-like leg integrally joined together at a forwardly directed acute angle apex with the free ends of the legs located at, and being beneath, the rear of the shoe;

and a leaf-like intermediate leg located within the V-shape, between and integrally joined with one, and extending towards the other, of the upper and lower legs, and having a free end portion which is normally spaced from, but under sufficient pressure moves towards and bottoms out against a portion of the leg with which it is not joined;

wherein the free end portions of the upper and lower legs resiliently compress together under wearer foot pressure at a predetermined, generally uniform spring rate, until the intermediate leg bottoms out and thereafter, under further pressure, the spring means continues compressing at a predetermined increased spring rate which is considerably more resistant to compression.

2. A construction as defined in claim 1, and said intermediate leg being roughly parallel to the leg with which it is not joined.

3. A construction as defined in claim 2, and a heel covering layer being provided upon the lower surface of the lower leg.

4. A construction as defined in claim 2, and the bottom of the shoe rearward heel portion being sloped in a rearwardly and upwardly direction, roughly corresponding to the slope of the upper exposed surface of the upper leg and being connected in face to face contact thereto.

5. A construction as defined in claim 4, and a heel covering layer connected in face to face contact with the lower surface of the lower leg.

6. A construction as defined in claim 5, and the leg surface contacting face of the heel covering being arranged at a forwardly and upwardly directed acute angle relative to the lower support surface engaging face of the heel covering.

7. A spring heel shoe comprising:

a shoe formed for receiving a wearer's foot and having a bottom which is generally formed as a forward sole portion and a rearward heel portion;

an undamped, compression spring means provided at the heel portion for resiliently compressing under the pressure of the rear, heel portion of the wearer's foot directed towards the ground support, and for resiliently expanding upon release of such pressure for returning a substantial portion of the energy of such pressure;

said spring means being formed of an integral V-shape, made of a stiff, springy material, providing an upper leaf-like leg and a lower, leaf-like leg integrally joined together at a forwardly directed acute angle apex with the free ends of the legs located at, and being beneath, the rear of the shoe;

and an intermediate leg being V-shaped to provide a first leg forming portion integral at its free end with said lower leg, and a second leg forming portion integral at its free end with said upper leg and an apex portion spaced from and located about midway between said lower and upper legs;

and a stop formed upon one of said upper and lower legs, which stop is normally spaced from but is located adjacent to, for engaging with, said intermediate leg apex portion when the upper and lower legs compress sufficiently for the intermediate leg portions to begin compression towards each other.

8. A springy heel shoe comprising:

a shoe formed for receiving a wearer's foot and having a bottom which is generally formed as a forward sole portion and a rearward heel portion;

an undamped, compression spring means provided at the heel portion for resiliently compressing under the pressure of the rear, heel portion of the wearer's foot directed towards the ground support, and for resiliently expanding upon release of such pressure for returning a substantial portion of the energy of such pressure;

said spring means being formed of an integral V-shape, made of a stiff, springy material, providing an upper leaf-like leg and a lower, leaf-like leg integrally joined together at a forwardly directed acute angle apex with the free ends of the legs located at, and being beneath, the rear of the shoe;

and said lower leaf-like leg having a forward portion adjacent the apex and a rearward, free end portion, with the two portions being integrally joined together by an intermediate leg;

the forward portion being at a more acute angle relative to the upper leg than the angle of the rearward portion relative to the upper leg;

and the intermediate leg being at an acute angle relative to said forward portion.

* * * * *